US010369587B2

(12) United States Patent
Wang et al.

(10) Patent No.: US 10,369,587 B2
(45) Date of Patent: Aug. 6, 2019

(54) ADHESIVE COATING DEVICE

(71) Applicant: GOERTEK INC., Weifang, Shandong (CN)

(72) Inventors: Bin Wang, Shandong (CN); Guixun Wang, Shandong (CN)

(73) Assignee: GOERTEK INC., Weifang, Shandong (CN)

( * ) Notice: Subject to any disclaimer, the term of this patent is extended or adjusted under 35 U.S.C. 154(b) by 0 days.

(21) Appl. No.: 15/541,837

(22) PCT Filed: Dec. 18, 2015

(86) PCT No.: PCT/CN2015/097822
§ 371 (c)(1),
(2) Date: Jul. 6, 2017

(87) PCT Pub. No.: WO2016/206327
PCT Pub. Date: Dec. 29, 2016

(65) Prior Publication Data

US 2018/0001335 A1 Jan. 4, 2018

(30) Foreign Application Priority Data

Jun. 23, 2015 (CN) ..... 2015 1 0349934

(51) Int. Cl.
*B05C 5/02* (2006.01)
*B05C 11/10* (2006.01)
(Continued)

(52) U.S. Cl.
CPC ..... *B05C 5/0254* (2013.01); *B05C 5/004* (2013.01); *B05C 5/0212* (2013.01); *B05C 11/10* (2013.01);
(Continued)

(58) Field of Classification Search
USPC ..... 118/300, 407, 410–412; 239/129, 145.1, 239/135, 402.15; 156/578, 245
See application file for complete search history.

(56) References Cited

U.S. PATENT DOCUMENTS 3,620,414 A * 11/1971 Philipps ..... B67B 7/28 222/132
5,344,666 A * 9/1994 Levine ..... A61B 10/0096 118/300
(Continued)

FOREIGN PATENT DOCUMENTS

CN 101099960 A 1/2008
CN 201161234 Y 12/2008
(Continued)

OTHER PUBLICATIONS

International Search Report for PCT/CN2015/097822, dated Mar. 25, 2016, ISA/CN.

*Primary Examiner* — Yewebdar T Tadesse
(74) *Attorney, Agent, or Firm* — Yue (Robert) Xu; Apex Attorneys at Law, LLP

(57) ABSTRACT

An adhesive coating device includes two adhesive barrels, lower ends of the two adhesive barrels are both connected to an adhesive coating assembly. The adhesive coating assembly includes an upper substrate having two mounting holes, lower ports of the two adhesive barrels passing through the two mounting holes respectively; a lower substrate detachably mounted at a lower side of the upper substrate. An adhesive receiving space is formed between the upper substrate and the lower substrate, and an adhesive coating track is provided on the lower substrate at a position corresponding to the adhesive receiving space, the adhesive coating track is a slit extending through an upper side and a lower side of the lower substrate, and the shape and size of the adhesive coating track match with the shape and size of
(Continued)

an adhesive coating track required by a product to be coated with adhesive.

19 Claims, 5 Drawing Sheets

(51) Int. Cl.
*B05C 17/005* (2006.01)
*B05C 5/00* (2006.01)

(52) U.S. Cl.
CPC .... *B05C 11/1039* (2013.01); *B05C 17/00516* (2013.01)

(56) References Cited

U.S. PATENT DOCUMENTS

2002/0074357 A1* 6/2002 Karr ..... B65D 83/207 222/190
2005/0150449 A1* 7/2005 Matsunaga ..... B05B 9/005 118/300
2008/0007283 A1 1/2008 Lin
2011/0223342 A1 9/2011 Iyer et al.
2011/0253039 A1 10/2011 Mashimo
2015/0224258 A1* 8/2015 Holtwick ..... A61M 5/19 604/506

FOREIGN PATENT DOCUMENTS

CN 102781591 A 11/2012
CN 202778870 U 3/2013
CN 203448244 U 2/2014
CN 203459237 U 3/2014
CN 103831208 A 6/2014
CN 104923442 A 9/2015
CN 204724395 U 10/2015
JP H11233533 A 8/1999

* cited by examiner

ADHESIVE COATING DEVICE

This application is the national phase of International Application No. PCT/CN2015/097822, titled "ADHESIVE COATING DEVICE", filed on Dec. 18, 2015, which claims the benefit of priority to Chinese Patent Application No. 201510349934.0 titled "ADHESIVE COATING DEVICE", filed with the Chinese State Intellectual Property Office on Jun. 23, 2015, the entire disclosures of which are incorporated herein by reference.

FIELD

The present application relates to the technical field of sealing equipment, and more particularly to an adhesive coating device.

BACKGROUND

An adhesive coating device is a production apparatus for realizing the sealing and fixation between two components. The structure of an adhesive coating device in the conventional technology is shown in FIG. 1, which includes two adhesive barrels 10 connected side by side. An adhesive stopper 12 is provided at an upper port of each of the two adhesive barrels 10, and the adhesive stopper 12 is provided with a through hole for communicating with an inner cavity of the adhesive barrel 10. The through hole in one of the adhesive stoppers 12 is for communicating with an adhesive source and the through hole in the other adhesive stopper 12 is for communicating with an air source. A lower end of each of the two adhesive barrels 10 is provided with a lower port 14 having a caliber smaller than the diameter of the adhesive barrel 10. The lower port 14 is a cylindrical structure having a certain length, and a needle 20 is mounted at each of the two lower ports 14. The adhesive barrel 10 in connection with the adhesive source is used to realize the function of applying adhesive on the product, and the adhesive barrel 10 in connection with the air source is used to realize the function of suctioning excess adhesive. When the adhesive coating device operates, it requires the device to carry the adhesive barrels 10 and the needles 20 to perform the adhesive coating process, and an adhesive coating track is mainly achieved by a motion track of the device. The adhesive coating device has a simple structure, but has the following defects in the using process.

First, the device carries the adhesive barrels and the needles to move on the product to form the adhesive coating track, therefore, when the device moves fast, it is apt to cause interruption of adhesive coating, and when the device moves slowly, it is apt to cause adhesive overflowing, and thus the adjustment is difficult.

Secondly, the coating process is overly relied on the operation of the operator, which leads to a low adhesive coating efficiency.

Thirdly, for complex curve coating, an accuracy of the adhesive coating track is low, and the quality of the adhesive coating is low.

Fourthly, a large adhesive dot is apt to be formed at the starting point of the adhesive coating process.

SUMMARY

In view of the above deficiencies, the technical issue to be addressed by the present application is to provide an adhesive coating device, which can customize an adhesive coating track according to the product requirement to realize a one-step formation of the adhesive coating track, and can be simply adjusted and be easy to operate, have a high adhesive coating efficiency and a high adhesive coating quality.

To address the above technical issues, the technical solutions of the present application are as follows.

An adhesive coating device includes two adhesive barrels connected side by side, wherein lower ends of the two adhesive barrels are both connected to an adhesive coating assembly, and the adhesive coating assembly includes: an upper substrate having two mounting holes, lower ports of the two adhesive barrels passing through the two mounting holes respectively; a lower substrate detachably mounted at a lower side of the upper substrate, wherein an adhesive receiving space is formed between the upper substrate and the lower substrate, and an adhesive coating track is provided on the lower substrate at a position corresponding to the adhesive receiving space, the adhesive coating track is a slit extending through an upper side and a lower side of the lower substrate, and the shape and size of the adhesive coating track match with the shape and size of an adhesive coating track required by a product to be coated with adhesive; and wherein the lower ports of the two adhesive barrels are both in communication with the adhesive receiving space.

Optionally, an adhesive blocking plate is provided between the upper substrate and the lower substrate, and the adhesive blocking plate is fixed to the upper substrate, and the two mounting holes are both within a positive projection area of the adhesive blocking plate, and the adhesive blocking plate separates the adhesive receiving space into an upper adhesive receiving space and a lower adhesive receiving space; and two opposite edge portions of the adhesive blocking plate are respectively provided with two adhesive through slots, and the two adhesive through slots are both in communication with the adhesive receiving spaces located at an upper side and a lower side of the adhesive blocking plate.

Optionally, a first sealing ring is provided between the upper substrate and the lower substrate at a portion surrounding the adhesive receiving space.

Optionally, two edge portions, which are not provided with the adhesive through slots, of the adhesive blocking plate are fixed to the upper substrate by two bolts respectively; and two second sealing rings are respectively provided at ends, in contact with the lower substrate, of the two bolts.

Optionally, the adhesive receiving space located at the upper side of the adhesive blocking plate is formed by a depression portion located in a middle part of the upper substrate.

Optionally, the adhesive receiving space located at the lower side of the adhesive blocking plate is formed by an adhesive receiving groove located in a middle part of the lower substrate, and the adhesive coating track is located in the adhesive receiving groove.

Optionally, the slit forming the adhesive coating track has a port located at an adhesive receiving groove side, and the port is a bell mouth.

Optionally, the lower substrate is provided with a sealing groove, and the first sealing ring is located in the sealing groove.

Optionally, the adhesive coating track is rectangular, circular, runway-shaped or linear.

Optionally, upper ends of the two adhesive barrels are respectively provided with two adhesive stoppers, and each of the two adhesive stoppers is provided with a through hole in communication with an inner cavity of the respective adhesive barrel.

With the above technical solutions, the present application has the following beneficial effects.

The adhesive coating device according to the present application includes two adhesive barrels connected side by side, and the lower ends of the two adhesive barrels are both connected to an adhesive coating assembly. The adhesive coating assembly includes an upper substrate and a lower substrate which are detachably assembled. An adhesive receiving space is formed between the upper substrate and the lower substrate, and the lower ports of the two adhesive barrels pass through the upper substrate to be in communication with the adhesive receiving space. The lower substrate is provided with an adhesive coating track at a position corresponding to the adhesive receiving space, and the adhesive coating track is a slit extending through an upper side and a lower side of the lower substrate. The shape and size of the adhesive coating track match with the shape and size of the adhesive coating track required by the product to be coated with adhesive. One of the two adhesive barrels is an adhesive coating barrel and the other one is an adhesive suction barrel. When coating the adhesive, the lower substrate having an adhesive coating track which is the same as that required by the product is fixed to a lower side of the upper substrate, the adhesive coating track on the lower substrate is aligned with the adhesive coating portion on the product, then the adhesive source is controlled to allow the adhesive inside the adhesive coating barrel to flow into the adhesive receiving space, and flow onto the product via the slit forming the adhesive coating track on the lower substrate, and be solidified onto the product in accordance with the shape of the adhesive coating track, to realize the sealing and fixation of the product, and the adhesive suction barrel suctions excess adhesive. According to the above working process, the adhesive coating device according to the present application does not need to move the adhesive barrel when coating adhesive and only needs to align the adhesive coating track on the lower substrate with the adhesive coating portion on the product, thus, by means of the slit arranged in the lower substrate, the one-step formation of the adhesive coating track with different shapes can be realized, therefore the adhesive coating device according to the present application has the following advantages compared with the conventional technology.

Firstly, since the adhesive coating track is not formed by moving the device, the device is relatively easy to adjust and easy to operate.

Secondly, the adhesive coating track is formed by a one-step process, thus the adhesive coating efficiency is high.

Thirdly, the adhesive coating track has a high precision, and the adhesive coating has a high quality.

Fourthly, the track has no junction, therefore, a large adhesive dot will not be formed at the starting point.

Fifthly, the device does not need to move, thus has a small abrasion and a long service life.

The adhesive blocking plate is provided between the upper substrate and the lower substrate, the two mounting holes are both within the positive projection area of the adhesive blocking plate, and the adhesive blocking plate separates the adhesive receiving space into an upper space and a lower space. Two opposite edge portions of the adhesive blocking plate are respectively provided with two adhesive through slots, and the two adhesive through slots are both in communication with the adhesive receiving spaces located at the upper side and the lower side of the adhesive blocking plate. The adhesive blocking plate has a blocking function between the adhesive coating track and the two lower ports of the two adhesive barrels. The adhesive passes through the adhesive through slots at two sides of the adhesive blocking plate, which can effectively prevent a portion of the adhesive coating track near the adhesive coating barrel from having excess adhesive in which case an adhesive overflowing may be caused, and prevent a portion of the adhesive coating track near the adhesive suction barrel from having too little adhesive in which case a defect of interruption of adhesive coating may be caused, thereby further improving the quality of the adhesive coating.

Since the first sealing ring is provided between the upper substrate and the lower substrate at a portion surrounding the adhesive receiving space, which can effectively prevent the phenomenon that the adhesive cannot fully enter the adhesive receiving space due to an untight conjunction between the upper substrate and the lower substrate and thus overflowing through a gap between the upper substrate and the lower substrate, thereby not only saving the adhesive, but also improving the adhesive coating quality, and moreover extending the service life of the adhesive coating device.

Since the two edge portions, which are not provided with the adhesive through slots, of the adhesive blocking plate are fixed to the upper substrate by two bolts respectively, and two second sealing rings are respectively arranged on ends, in contact with the lower substrate, of the two bolts. The second sealing rings can ensure the tightness of the conjunction between the lower substrate and the adhesive blocking plate, and can effectively prevent the adhesive in the adhesive receiving space at the lower side of the adhesive blocking plate from overflowing out of there, thereby further saving the adhesive and improving the adhesive coating quality, and extending the service life of the adhesive coating device.

Since the port, located at the adhesive receiving groove side, of the slit forming the adhesive coating track is a bell mouth, and the bell mouth has a guiding effect, which makes it easy for the adhesive in the adhesive receiving groove to sufficiently flow into the adhesive coating track, thus improving the coating efficiency while improving the quality of the adhesive coating.

In conclusion, the adhesive coating device according to the present application addresses the technical issues of the adhesive coating device in the conventional technology such as having a poor adhesive coating quality and having difficulty in implementing complicated adhesive coating track. The adhesive coating device according to the present application can realize a one-step formation of the adhesive coating track as required, thus the device is easy to adjust and easy to operate, and has a high adhesive coating efficiency, a high adhesive coating quality and a long service life.

BRIEF DESCRIPTION OF THE DRAWINGS

For more clearly illustrating embodiments of the present application or technical solutions in the conventional technology, the drawings referred to describe the embodiments or the conventional technology will be briefly described hereinafter. Apparently, the drawings in the following description are only some examples of the present application, and for the person skilled in the art, other drawings may be obtained based on these drawings without any creative efforts.

REFERENCE NUMERALS

| | | | |
|---|---|---|---|
| 10 | adhesive barrel, | 12 | adhesive stopper, |
| 120 | through hole, | 14 | lower port, |
| 20 | needle, | 30 | upper substrate, |
| 32 | mounting hole, | 34 | depression area, |
| 40 | adhesive blocking plate, | 42 | second positioning hole, |
| 44 | adhesive through slot, | 50 | second bolt, |
| 52 | first bolt, | 54 | second sealing ring, |
| 56 | first sealing ring, | 60 | lower substrate, |
| 62 | first positioning hole, | 64 | sealing groove, |
| 66 | adhesive receiving groove, | 68 | adhesive coating track, |
| 680 | bell mouth, | 70 | product, |
| 72 | adhesive coating portion, and | 80 | adhesive. |

DETAILED DESCRIPTION

The present application is further described with reference to the drawings and embodiments.

The directions and positions referred to in this specification are based on the directions and positions of the adhesive coating device according to the present application in normal operation, and do not limit its directions and positions in storage and transport, and only represent relative positional relationship rather than absolute positional relationship.

Figure 1:
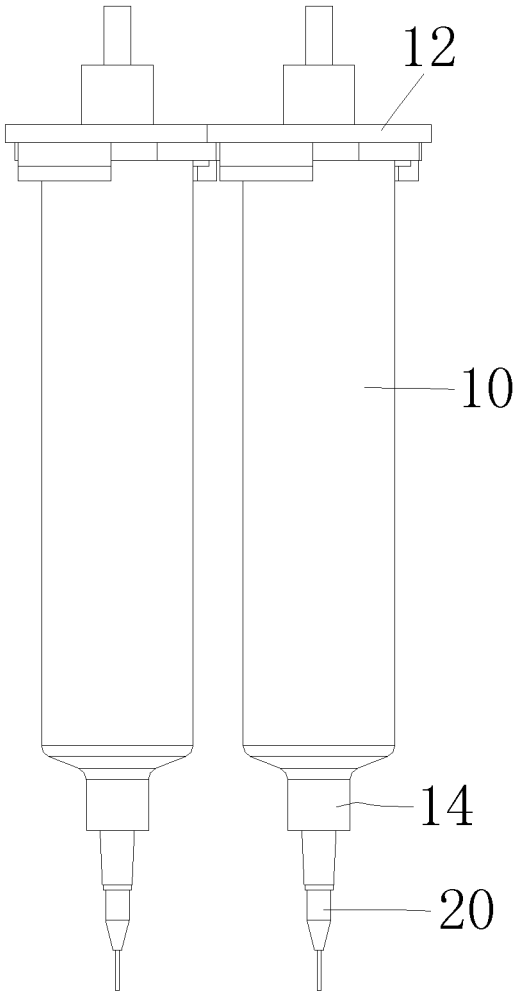
FIG. 1 is a schematic view showing the structure of an adhesive coating device in the conventional technology.
Figure 2:
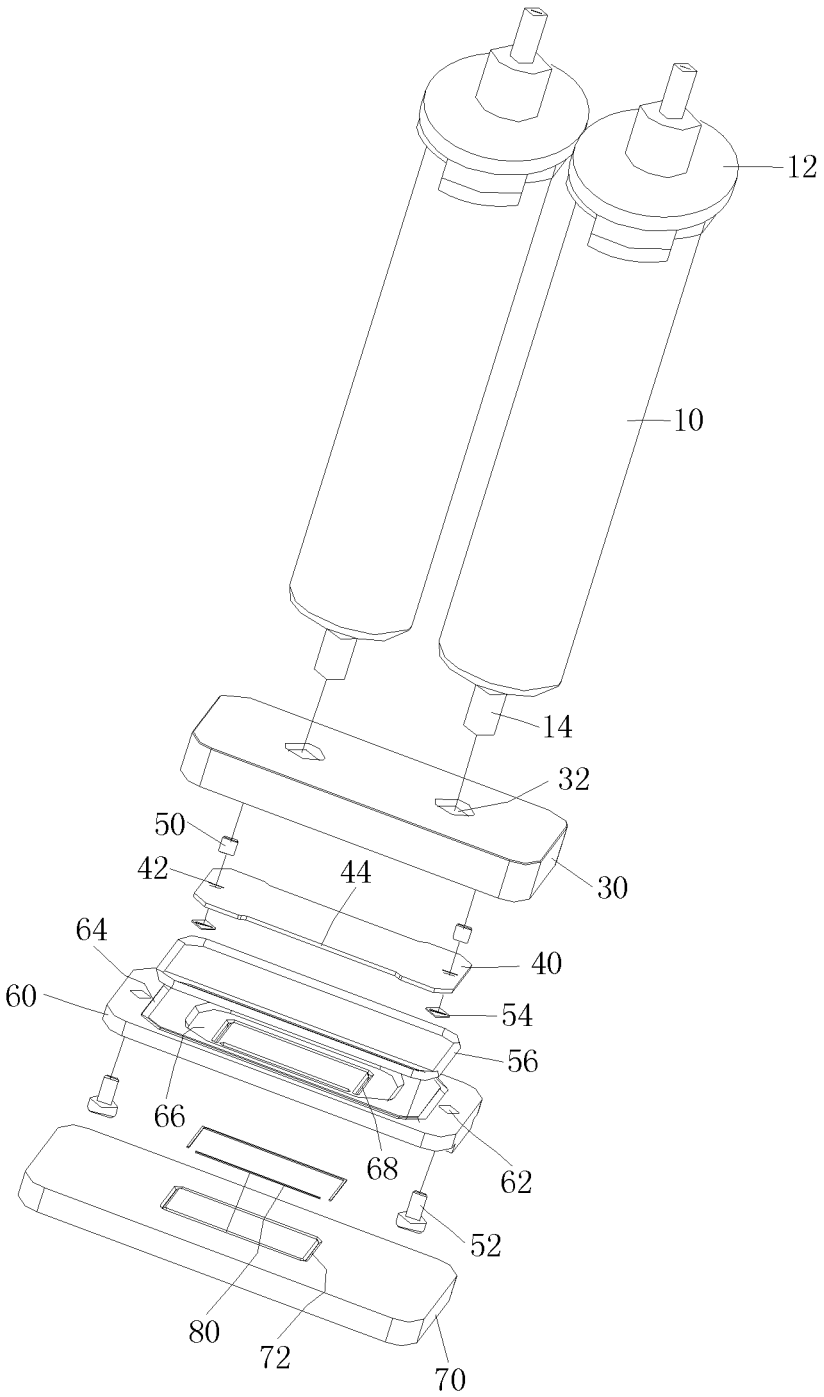
FIG. 2 is a schematic view showing an exploded structure of an adhesive coating device according to the present application.
Figure 3:
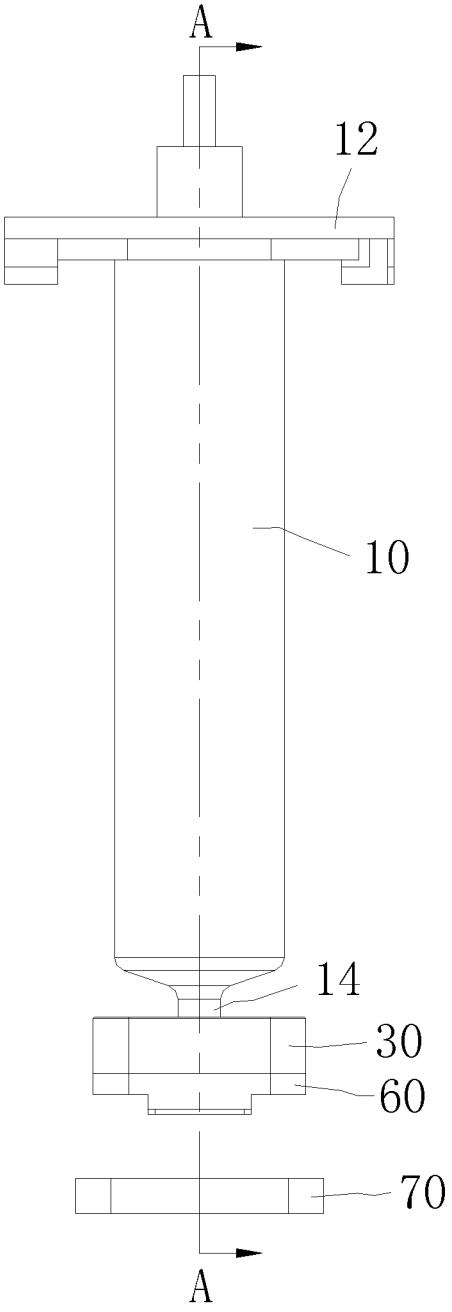
FIG. 3 is a view of FIG. 2 in an assembled state.
Figure 4:
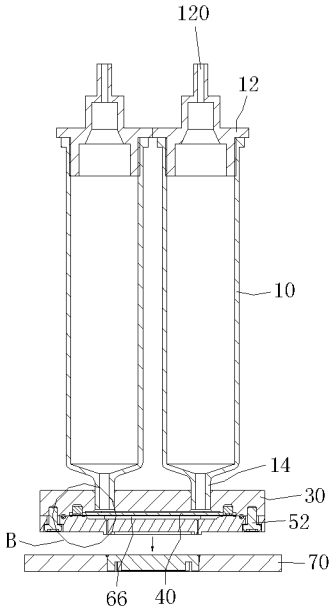
FIG. 4 is a sectional view of FIG. 3 taken along line A-A.

As shown in FIGS. 2, 3 and 4 together, an adhesive coating device includes two adhesive barrels 10 connected side by side, lower ends of the two adhesive barrels 10 are both connected to an adhesive coating assembly. Upper ends of the two adhesive barrels 10 are respectively provided with two adhesive stoppers 12, and each of the two adhesive stoppers 12 is provided with a through hole 120 configured to communicate an inner cavity of the respective adhesive barrel 10 with the outside. The lower ends of the two adhesive barrels 10 are respectively provided with two lower ports 14 each having a caliber smaller than a diameter of the respective adhesive barrel 10, and the two lower ports 14 each have a cylindrical structure. One of the two through holes 120 is connected to an adhesive feeding hose, and the corresponding adhesive barrel 10 is an adhesive coating barrel; the other through hole 120 is connected to an air suction tube, and the corresponding adhesive barrel 10 is an adhesive suction barrel. In the adhesive coating operation, the adhesive coating barrel is configured for applying adhesive and the adhesive suction barrel is configured for suctioning excess adhesive, thus, not only the adhesive consumption can be saved, but also the adhesive coating quality can be improved.

Figure 5:
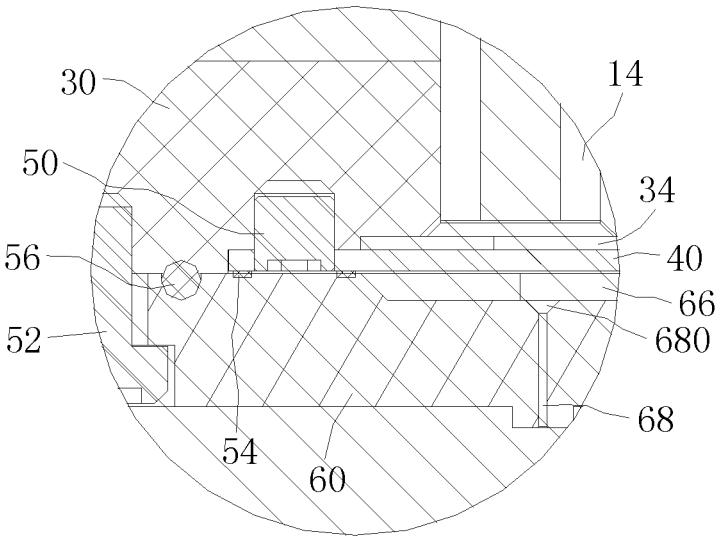
FIG. 5 is an enlarged view of part B in FIG. 4.

As shown in FIGS. 2, 4 and 5 together, the adhesive coating assembly includes a rectangular upper substrate 30. Two mounting hole 32 are respectively provided in the upper substrate 30 at positions corresponding to the two lower ports 14 of the two adhesive barrels 10, and the two lower ports 14 pass through the two mounting holes 32 respectively. A middle portion of a lower side of the upper substrate 30 is provided with a depression area 34. Opening ends, located at the lower side of the upper substrate 30, of the two mounting holes 32 are within the depression area 34, and the two lower ports 14 are both in communication with the depression area 34. An elongated adhesive blocking plate 40 is fixedly installed at the lower side of the upper substrate 30, and the length and width of the adhesive blocking plate 40 are less than the length and width of the upper substrate 30 respectively. The adhesive blocking plate 40 covers the depression area 34, and the two mounting holes 32 are both within a positive projection area of the adhesive blocking plate 40. Two ends (i.e., edge portions of the two short sides) of the adhesive blocking plate 40 are respectively provided with two second positioning hole 42, and two second bolts 50 pass through the two second positioning holes 42 respectively to fix the adhesive blocking plate 40 to the lower side of the upper substrate 30. After the adhesive blocking plate 40 is fixed on the upper substrate 30, a lower surface of the adhesive blocking plate 40 is flush with a lower surface of the upper substrate 30, and the depression area 34 forms an upper adhesive receiving space above the adhesive blocking plate 40.

As shown in FIGS. 2, 4 and 5 together, a lower substrate 60 is further joined to the lower side of the upper substrate 30, and the lower substrate 60 has the identical size and shape as those of the upper substrate 30. Two first positioning hole 62 are respectively provided in two ends of the lower substrate 60, and two first bolts 52 pass through the two first positioning holes 62 respectively to fix the lower substrate 60 to the upper substrate 30, and the lower substrate 60 is detachably connected to the upper substrate 30, that is, the lower substrate 60 can be replaced as required when the adhesive coating of a different track is performed. A middle portion of the lower substrate 60 has a downwardly depressed adhesive receiving groove 66 at a position corresponding to the depression area 34 of the upper substrate 30. The adhesive receiving groove 66 forms a lower adhesive receiving space below the adhesive blocking plate 40, and an adhesive coating track 68 is arranged on the lower substrate 60 within the adhesive receiving groove 66. The adhesive coating track 68 is a slit extending through an upper side and a lower side of the lower substrate 60, and the shape and size of the adhesive coating track 68 are consistent with the shape and size of a required adhesive coating track of a product to be coated with adhesive. The slit, forming the adhesive coating track 68, has a port at the side of the adhesive receiving groove 66, and this port is a bell mouth 680, which make it easy for the adhesive within the adhesive receiving groove 66 to flow into the adhesive coating track 68 to be applied on the product.

As shown in FIG. 2, two long edges of the adhesive blocking plate 40 are respectively provided with two adhesive through slots 44 depressed into the adhesive blocking plate 40, and the upper adhesive receiving space is in communication with the lower adhesive receiving space via the adhesive through slots 44. The adhesive being applied downwards or the adhesive being suctioned upwardly can both pass through the adhesive through slots 44 at the two sides. This structure may effectively prevent a portion of the adhesive coating track 68 near the adhesive coating barrel from having excess adhesive in which case an adhesive overflowing may be caused, and prevent a portion of the adhesive coating track 68 near the adhesive suction barrel from having too little adhesive in which case a defect of interruption of adhesive coating may be caused, thereby ensuring the quality of the adhesive coating.

As shown in FIGS. 2, 4 and 5 together, a portion of the lower substrate 60 that is outside the adhesive receiving groove 66 is provided with a ring-shaped sealing groove 64, and a first sealing ring 56 is arranged in the ring-shaped sealing groove 64. The first sealing ring 56 is located between the upper substrate 30 and the lower substrate 60 and surrounds the adhesive blocking plate 40, thereby ensuring the tightness of the conjunction between the upper substrate 30 and the lower substrate 60. Two second sealing rings 54 are respectively provided at outer circumferences of ends, in contact with the lower substrate 60, of the two second bolts 50, and the two second sealing rings 54 are located between the adhesive blocking plate 40 and the lower substrate 60, which can prevent the adhesive in the lower adhesive receiving space from overflowing out of there.

Figure 6:
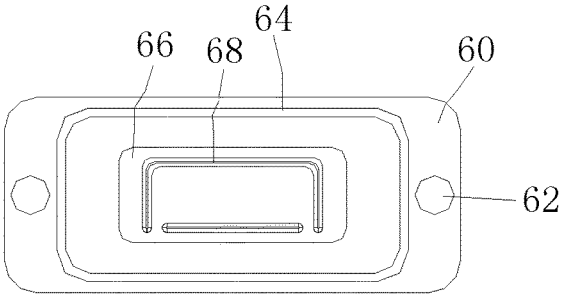
FIG. 6 is a schematic view showing one structure of a lower substrate of the adhesive coating device according to the present application.

As shown in FIGS. 2, 4 and 6 together, the adhesive coating track 68 on the lower substrate 60 has a rectangular shape which is the same as the shape of the track of an adhesive coating portion 72 on a product 70. In order to show the structure more visually, the adhesive 80 is separated from the product 70 in FIG. 2, and the separated adhesive 80 is shown in the actual shape of the adhesive 80 after being solidified when the adhesive 80 is applied to the adhesive coating portion 72 of the product 70, and has the same shape and the same size as those of the adhesive coating portion 72.

Figure 7:
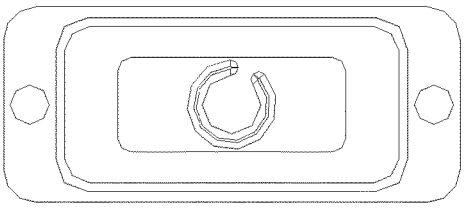
FIG. 7 is a schematic view showing another structure of the lower substrate of the adhesive coating device according to the present application.
Figure 8:
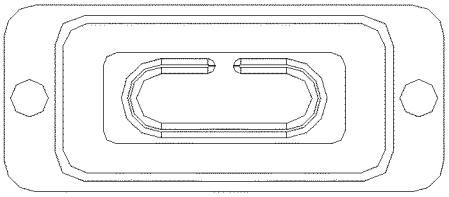
FIG. 8 is a schematic view showing yet another structure of the lower substrate of the adhesive coating device according to the present application.
Figure 9:
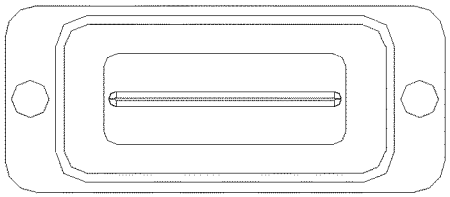
FIG. 9 is a schematic view showing still another structure of the lower substrate of the adhesive coating device according to the present application.

The adhesive coating track 68 on the lower substrate 60 shown in FIG. 6 has a rectangular structure. In the practical application, the track that can be coated by the adhesive coating device according to the present application is not limited to the rectangular structure, but may also be other simple or complicated structures, such as a circular adhesive coating track shown in FIG. 7, a runway-shaped adhesive coating track shown in FIG. 8, a linear adhesive coating track shown in FIG. 9, which is not limited to the above-mentioned types. The adhesive coating device according to the present application may coat the adhesive for adhesive coating tracks of any structures according to requirements of the products. Since the adhesive coating tracks have numerous structures, FIGS. 6, 7, 8 and 9 only show the structures of the lower substrates having several commonly used adhesive coating tracks. The lower substrate having the adhesive coating tracks of other structures can be easily produced by the person skilled in the art in accordance with the description of this specification and FIGS. 6 to 9, therefore, the lower substrates having adhesive coating tracks of other structures are not listed herein.

The working principle of the adhesive coating device according to the present application is described as follows:

As shown in FIGS. 2 and 4 together, firstly, the lower substrate 60 having the adhesive coating track 68 with the same structure as that of the adhesive coating portion 72 on the product 70 is fixedly installed on the upper substrate 30, then the adhesive coating track 68 is aligned with the adhesive coating portion 72, and then the adhesive in the adhesive coating barrel flows into the upper adhesive receiving space via the lower port 14, and enters the lower adhesive receiving space via the adhesive through slots 44 in the adhesive blocking plate 40, and then flows into the adhesive coating track 68 and is coated on the adhesive coating portion 72 of the product 70, and excess adhesive is suctioned by the adhesive suction barrel.

According to the above working principle, the adhesive coating device according to the present application can realize the one-step formation of the adhesive coating track of various types, thus the operation is simple, the adhesive coating efficiency is high, and the adhesive coating quality is high.

The feature naming with series numbers (such as the first sealing ring and the second sealing ring) referred to in this specification are only for the purpose of distinguishing technical features and do not represent the positional relationship between the features, the assembly order and the working order, and etc.

The present application is not limited to the above specific embodiments, and various changes, made by the person skilled in the art based on the above-described concepts without creative efforts, all fall into the scope of protection of the present application.

What is claimed is:

1. An adhesive coating device, comprising two adhesive barrels connected side by side, wherein one of the two adhesive barrels being an adhesive coating barrel configured to apply adhesive and the other one of two adhesive barrels being an adhesive suction barrel configured to suction excess adhesive, lower ends of the two adhesive barrels are both connected to an adhesive coating assembly, and the adhesive coating assembly comprises:

an upper substrate having two mounting holes, lower ports of the two adhesive barrels passing through the two mounting holes respectively;

a lower substrate detachably mounted at a lower side of the upper substrate, wherein an adhesive receiving space is formed between the upper substrate and the lower substrate, and an adhesive coating track is provided on the lower substrate at a position corresponding to the adhesive receiving space, the adhesive coating track is a slit extending through an upper side and a lower side of the lower substrate, and the shape and size of the adhesive coating track match with the shape and size of an adhesive coating track required by a product to be coated with adhesive; and wherein, the lower ports of the two adhesive barrels are both in communication with the adhesive receiving space; and wherein an adhesive blocking plate is provided between the upper substrate and the lower substrate, and the adhesive blocking plate is fixed to the upper substrate, and the two mounting holes are both within a positive projection area of the adhesive blocking plate, and the adhesive blocking plate separates the adhesive receiving space into an upper adhesive receiving space and a lower adhesive receiving space; and two opposite edge portions of the adhesive blocking plate are respectively provided with two adhesive through slots, and the two adhesive through slots are both in communication with the adhesive receiving spaces located at an upper side and a lower side of the adhesive blocking plate.

2. The adhesive coating device according to claim 1, wherein a first sealing ring is provided between the upper substrate and the lower substrate at a portion surrounding the adhesive receiving space.

3. The adhesive coating device according to claim 2, wherein another two edge portions, which are not provided with the adhesive through slots, of the adhesive blocking plate are fixed to the upper substrate by two bolts respectively; and two second sealing rings are respectively provided at ends, in contact with the lower substrate, of the two bolts.

4. The adhesive coating device according to claim 3, wherein the adhesive receiving space located at the upper side of the adhesive blocking plate is formed by a depression portion located in a middle part of the upper substrate.

5. The adhesive coating device according to claim 4, wherein the adhesive receiving space located at the lower side of the adhesive blocking plate is formed by an adhesive receiving groove located in a middle part of the lower substrate, and the adhesive coating track is located in the adhesive receiving groove.

6. The adhesive coating device according to claim 5, wherein the slit forming the adhesive coating track has a port located at an adhesive receiving groove side, and the port is a bell mouth.

7. The adhesive coating device according to claim 6, wherein the lower substrate is provided with a sealing groove, and the first sealing ring is located in the sealing groove.

8. The adhesive coating device according to claim 7, wherein the adhesive coating track is rectangular, circular, runway-shaped or linear.

9. The adhesive coating device according to claim 2, wherein the adhesive receiving space located at the upper side of the adhesive blocking plate is formed by a depression portion located in a middle part of the upper substrate.

10. The adhesive coating device according to claim 9, wherein the adhesive receiving space located at the lower side of the adhesive blocking plate is formed by an adhesive receiving groove located in a middle part of the lower substrate, and the adhesive coating track is located in the adhesive receiving groove.

11. The adhesive coating device according to claim 10, wherein the slit forming the adhesive coating track has a port located at an adhesive receiving groove side, and the port is a bell mouth.

12. The adhesive coating device according to claim 11, wherein the lower substrate is provided with a sealing groove, and the first sealing ring is located in the sealing groove.

13. The adhesive coating device according to claim 12, wherein the adhesive coating track is rectangular, circular, runway-shaped or linear.

14. The adhesive coating device according to claim 1, wherein the adhesive receiving space located at the upper side of the adhesive blocking plate is formed by a depression portion located in a middle part of the upper substrate.

15. The adhesive coating device according to claim 14, wherein the adhesive receiving space located at the lower side of the adhesive blocking plate is formed by an adhesive receiving groove located in a middle part of the lower substrate, and the adhesive coating track is located in the adhesive receiving groove.

16. The adhesive coating device according to claim 15, wherein the slit forming the adhesive coating track has a port located at an adhesive receiving groove side, and the port is a bell mouth.

17. The adhesive coating device according to claim 16, wherein the lower substrate is provided with a sealing groove, and the first sealing ring is located in the sealing groove.

18. The adhesive coating device according to claim 17, wherein the adhesive coating track is rectangular, circular, runway-shaped or linear.

19. The adhesive coating device according to claim 1, wherein upper ends of the two adhesive barrels are respectively provided with two adhesive stoppers, and each of the two adhesive stoppers is provided with a through hole in communication with an inner cavity of the respective adhesive barrel.

* * * * *